US012692671B2

(12) United States Patent
Berns et al.

(10) Patent No.: US 12,692,671 B2
(45) Date of Patent: Jul. 28, 2026

(54) AUGER AND CONVEYOR SPEED CONTROL

(71) Applicant: Caterpillar Paving Products Inc., Brooklyn Park, MN (US)

(72) Inventors: Reece Berns, Blaine, MN (US); Jacob R. Ellwein, Oak Grove, MN (US)

(73) Assignee: Caterpillar Inc., Peoria, IL (US)

( * ) Notice: Subject to any disclaimer, the term of this patent is extended or adjusted under 35 U.S.C. 154(b) by 647 days.

(21) Appl. No.: 18/295,501

(22) Filed: Apr. 4, 2023

(65) Prior Publication Data

US 2024/0337075 A1 Oct. 10, 2024

(51) Int. Cl.
*E01C 19/20* (2006.01)
*E01C 19/10* (2006.01)

(52) U.S. Cl.
CPC ..... *E01C 19/20* (2013.01); *E01C 19/1063* (2013.01); *E01C 2019/207* (2013.01)

(58) Field of Classification Search
CPC ..... E01C 19/20; E01C 19/1063; E01C 2019/207; E01C 2019/208; E01C 2019/209
See application file for complete search history.

(56) References Cited

U.S. PATENT DOCUMENTS

| | | | | |
|---|---|---|---|---|
| 4,933,853 | A | 6/1990 | Musil et al. | |
| 5,588,776 | A | 12/1996 | Swisher et al. | |
| 7,172,363 | B2 | 2/2007 | Olson et al. | |
| 8,930,092 | B2 | 1/2015 | Minich | |
| 8,979,423 | B2 | 3/2015 | Smieja | |
| 9,004,811 | B2 | 4/2015 | Mings et al. | |
| 9,932,714 | B2 | 4/2018 | Graham et al. | |
| 10,246,833 | B2 | 4/2019 | Blank et al. | |
| 10,724,887 | B2 | 7/2020 | Thiesse et al. | |
| 10,961,666 | B2 | 3/2021 | Oetken | |
| 11,127,135 | B1 | 9/2021 | Mansell | |
| 2008/0226392 | A1* | 9/2008 | Lloyd | E01C 23/065 404/90 |
| 2012/0288328 | A1* | 11/2012 | Minich | G06Q 50/08 404/72 |
| 2013/0223927 | A1* | 8/2013 | Mings | E01C 19/48 404/72 |
| 2017/0030027 | A1 | 2/2017 | Frelich et al. | |
| 2018/0044863 | A1* | 2/2018 | Gamble | E01C 19/203 |
| 2021/0189661 | A1* | 6/2021 | Breault | E01C 19/522 |

FOREIGN PATENT DOCUMENTS

JP 4326544 B2 11/2007

* cited by examiner

*Primary Examiner* — William V Gilbert

(57) ABSTRACT

A paving system includes a paving machine including a drive assembly, a paving material delivery system, and a material depth sensor. The paving material delivery system includes a hopper, a conveyor assembly, an auger, and a screed. The material depth sensor is configured to detect a head of paving material in front of the screed. The paving machine further includes a controller in communication with the material depth sensor. The controller is configured to receive a feed sensor signal from the material depth sensor, receive an auger speed signal indicative of a speed of the auger, and adjust a conveyor speed based on at least one of the feed sensor signal and the auger speed signal.

20 Claims, 3 Drawing Sheets

AUGER AND CONVEYOR SPEED CONTROL

TECHNICAL FIELD

The present disclosure relates generally to a road construction machine, and more particularly, to a paving machine and a control system for a paving machine.

BACKGROUND

The present disclosure relates to paving machines that are used in road surface construction and repairs. Paving machines are typically utilized to lay asphalt or other paving material. Paving machines typically include a material feed system that may feed paving material from a hopper to a screed. The material feed system may include one or more conveyor assemblies and one or more augers that are located adjacent to the screed such that the one or more conveyor assemblies and augers can deliver paving material to be spread by the screed to form a mat of paving material. The amount of paving material and the rate at which the paving material is delivered to the screed by the conveyor assemblies and auger affects the thickness and consistency of the mat of paving material. Further, the speeds of the conveyor assemblies and auger, as well as the relative ratio of those speeds, affects the supply of material to the screed and, ultimately, the consistency and quality of the deposited mat.

U.S. Pat. No. 8,979,423 (hereinafter referred to as "the '423 patent") discloses a material feed system for controlling material feed for asphalt pavers. The material feed system includes a screed, feeder conveyor and a spreader auger. First and second sensors measure the distance to material and transmit this information to an electronic control module (ECM). This information may be used as the target material volume, which the ECM may use to calculate a corresponding conveyor speed and auger speed. The sensors monitor the distance of the material from the sensors as paving commences, and the ECM maintains the initial calibrated target size by adjusting the auger and conveyor rotational speeds. The material feed system of the '423 patent uses at least two sensors in order to accurately control the auger and conveyor rotational speeds, which may introduce complexity into the control system. The paving machine of the present disclosure may improve upon one or more aspects of the '423 patent. The scope of the current disclosure, however, is defined by the attached claims, and not by the ability to solve any specific problem.

SUMMARY

According to one aspect of the present disclosure, a paving system may include a paving machine including a drive assembly, a paving material delivery system, and a material depth sensor. The paving material delivery system may include a hopper, a conveyor assembly, an auger, and a screed. The material depth sensor may be configured to detect a head of paving material in front of the screed. The paving machine may further include a controller in communication with the material depth sensor. The controller may be configured to receive a feed sensor signal from the material depth sensor, receive an auger speed signal indicative of a speed of the auger, and adjust a conveyor speed based on at least one of the feed sensor signal and the auger speed signal.

In another aspect of the present disclosure, a method for controlling delivery of paving material from a paving machine may include setting a feed sensor depth, waiting for a head of paving material to stabilize at the feed sensor depth, determining a steady state rotation speed of an auger of the paving machine, automatically adjusting a speed of a conveyor of the paving machine based on the auger speed, and monitoring the speed of the auger at steady state for an auger speed outside of a predetermined speed range.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, system, or apparatus that comprises a list of elements does not include only those elements, but may include other elements not expressly listed or inherent to such a process, method, article, system, or apparatus.

For the purpose of this disclosure, the term "ground surface" is broadly used to refer to all types of surfaces that form typical roadways (e.g., asphalt, cement, clay, sand, dirt, etc.) or upon which paving material may be deposited in the formation of roadways. In this disclosure, relative terms, such as, for example, "about," "substantially," and "approximately" are used to indicate a possible variation of 10% in a stated value. Although the current disclosure is described with reference to a paving machine, this is only exemplary. In general, the current disclosure can be applied as to any machine, such as, for example, a paver finisher, asphalt finisher, or another paving-type machine.

Figure 1:
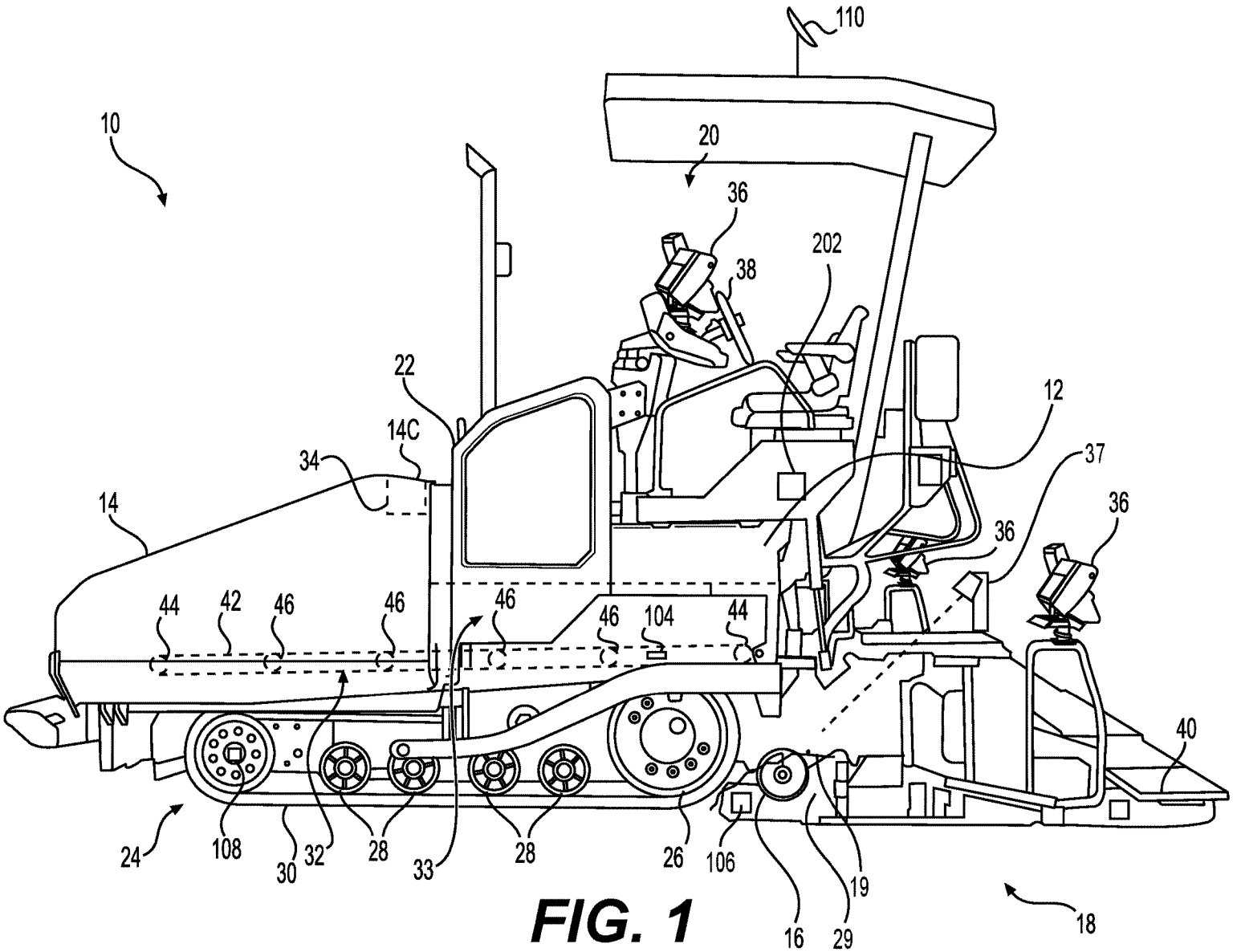
FIG. 1 is an illustration of an exemplary paving machine, according to an aspect of the present disclosure.

FIG. 1 illustrates a side view of an exemplary paving machine 10, according to the present disclosure. Machine 10 may be any size paver with any paving width. In one aspect, machine 10 may be a small paver, for example, with a maximum paving width of approximately 5.5 meters. Alternatively, in another aspect, machine 10 may be a large paver, for example, with a maximum paving width of approximately 11 meters. Machine 10 includes a frame 12, a hopper 14, an auger 16, and a screed 18. Machine 10 may also include an operator station 20, from which an operator may maneuver and control machine 10. Machine 10 may be propelled by an engine assembly 22 to power a drive assembly 24, including a drive wheel 26, one or more idlers 28, and tracks 30. Machine 10 includes a conveyor assembly 32 to transport paving material through a tunnel 33 from hopper 14 to auger 16 and screed 18. Screed 18 is positioned to the rear of auger 16. Once paving material is spread by auger 16, screed 18 smooths and compacts the paving material spread by auger 16 to form the mat. The height of screed 18 may be adjustable to control thickness of the mat and to avoid colliding with obstructions on the ground surface.

Machine 10 may also include a material volume sensor 34 to detect and/or measure an amount of paving material being carried by conveyor assembly 32. Additionally, machine 10 may include one or more control panels 36, for example, positioned in operator station 20 next to steering wheel 38, in one or more operator positions 40 on screed 18, and/or remote from machine 10, etc. Control panel(s) 36 may control and/or display information regarding one or more aspects of machine 10 via a controller 202. Control panels 36 may include or be coupled to (e.g., wired or wirelessly) controller 202. Control panel(s) 36 may include a touch screen user interface and/or other displays or input devices through which operator(s) can input information to, and receive information from, controller 202.

Hopper 14 may be positioned in a forward portion of frame 12 to receive and/or store the paving material, for example, from a mixer truck. Hopper 14 includes a rear portion 14C, which may help separate hopper 14 from the engine assembly 22 and other components of machine 10.

As mentioned, conveyor assembly 32 connects hopper 14 to auger 16 and screed 18 in a rear portion of machine 10 to convey the paving material. Conveyor assembly 32 may extend beneath engine assembly 22 and operator station 20, and may be positioned above drive assembly 24. Conveyor assembly 32 may include at least one conveyor belt 42 driven by at least one conveyor pulley 44. In one example, conveyor assembly 32 may include two conveyor pulleys 44, for example, one in a forward position and one in a rear position. For example, conveyor pulleys 44 may each rotate in order to drive conveyor belt 42 to deliver paving material from hopper 14 to auger 16 and screed 18. In another example, conveyor assembly 32 may include two conveyor belts 42, with each conveyor belt 42 being driven independently by a respective conveyor pulley 44. In one aspect, conveyor belt(s) 42 may travel over one or more plates or rollers 46, which may help support conveyor belt(s) 42.

Conveyor pulley(s) 44 may be driven by respective motors (for example, hydraulic motors) controlled by an electronic conveyor controller 104. Conveyor controller 104 may be configured to receive a signal from controller 202 to drive conveyor belt 42 at one or more preprogrammed and/or operator-input speeds. The speed of conveyor belt 42 may be determined based on, for example, a desired delivery rate of paving material to auger 16 and screed 18.

Auger 16 may be positioned perpendicular to the direction of travel of machine 10. Auger 16 may include a plurality of parallel or longitudinally arranged auger sections (that is, in a relatively widthwise manner with regard to the front and rear of machine 10). Auger 16 may be driven by a motor (for example, a hydraulic motor) controlled by an electronic auger controller 106. Auger controller 106 may be configured to receive a signal from controller 202 to drive auger 16 at one or more preprogrammed and/or operator-input speeds. The speed of auger 16 may be determined based on, for example, a desired deposition rate of paving material to the ground surface. In some aspects, auger speed may be in a range of about 20 revolutions per minute (rpm) to about 40 rpm during steady state operation of machine 10, based on empirically derived data for producing a quality, consistent mat.

Conveyor speed may be correlated to auger speed to ensure that a consistent volume of paving material is delivered without over- or under-loading screed 18, and to prevent erratic behavior of auger 16 that can affect consistency of the mat. For example, if auger speed increases due to increased material demand (e.g., if machine is traversing a pothole that needs filled with paving material), controller 202 may be configured to automatically increase the conveyor speed at a predetermined ratio relative to the auger speed to ensure auger 16 does not become starved of paving material.

With continued reference to FIG. 1, machine 10 further includes a material feed sensor 37 directed at a head 19 of paving material in front of screed 18. Material feed sensor 37 detects a distance from sensor 37 to head 19 of the paving material in front of screed 18. In some aspects, material feed sensor 37 may be an ultrasonic sensor configured to emit ultrasonic waves which reflect off of the paving material in screed 18. Sensor 37 detects the reflected ultrasonic waves and determines the distance from sensor 37 to the paving material in screed 18, from which sensor 37 (and/or controller 202) can determine the distance from sensor 37 to head 19 of paving material in front of screed 18. In other aspects, material depth sensor 37 may be a laser sensor, an optical sensor, a mechanical level sensor, or another suitable device for measuring distance to the paving material. Though a single material feed sensor 37 is shown in FIG. 1, aspects of the present disclosure may include multiple sensors directed at head 19 of paving material. In some aspects, controller 202 may be configured to determine a depth, volume, and/or a shape of head 19 of paving material using additional sensor inputs in conjunction with sensor 37.

As the depth of paving material may not be consistent across the length and/or width of head 19 of paving material in front of screed 18, sensor 37 may be positioned and oriented to detect head 19 at a predetermined, critical, location in front of screed 18. For example, sensor 37 may be positioned and oriented to detect head 19 of paving material coming off of the end of auger 16 and flowing out to an end gate 29, which is the location on head 19 of paving material most indicative of the where head 19 of paving material must be kept in front of screed 18 to ensure consistent paving. Sensor 37 may transmit information relating to the distance from sensor 37 to head 19 of the paving material in front of screed 18 to controller 202. Controller 202 may use this information to monitor the distance between sensor 37 and head 19 of paving material in front of screed 18 to ensure a sufficient amount of paving material is continuously delivered to auger 16 to deposit a mat of consistent thickness.

Figure 2:
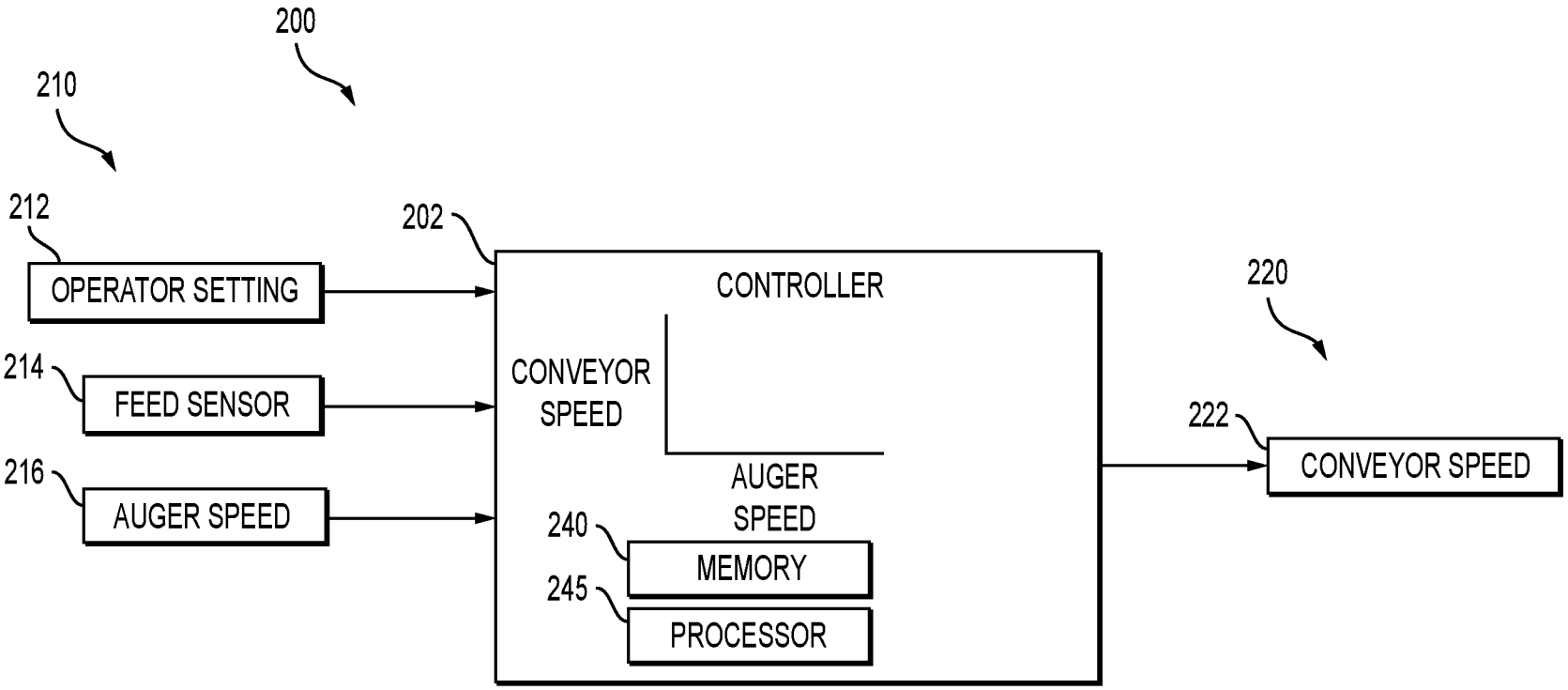
FIG. 2 is a block diagram of a control system of the paving machine of FIG. 1, according to an aspect of the present disclosure.

Referring now to FIGS. 1 and 2, controller 202 may be coupled to control panel(s) 36, material volume sensor 34, material depth sensor 37, conveyor controller 104, auger controller 106, and, in some aspects, to one or more additional sensors and/or to one or more actuators on machine 10 to form a control system 200. For example, machine 10 may also include one or more positioning sensors 110 (e.g., a global positioning system antenna, a LIDAR sensor, a stringline sensor, a total station unit to be detected or otherwise sensed by a universal total station monitor positioned on the worksite, etc.) for determining and executing an overall ground speed for machine 10. Additionally, machine 10 may include one or more additional actuators or controllers to control the movement of machine 10 and its components, such as, for example, a steering direction sensor and/or a steering direction controller. Each of the sensors, controllers, and/or actuators may be in communication (e.g., a wired connection or a wireless connection) with each other, for example, through controller 202. Moreover, in some aspects, one or both of conveyor controller 104 and auger controller 106 may be part of controller 202.

Although not shown, controller 202 may be in communication with additional sensors mounted to or within machine 10, for example, an odometer, a speedometer, temperature sensors, etc. Moreover, controller 202 may be in communication with additional displays or operator stations, for example, a central control station for the worksite, an electronic log or memory that stores operating instructions and/or records the positions and other operational aspects of machine 10 over a worksite, etc.

Control system 200 may include controller 202, which is configured for receiving various inputs 210 from various sources, and for providing outputs 220 to conveyor controller 104, auger controller 106, and various other devices of machine 10. For example, as one of inputs 210, controller 202 may receive an operator setting 212 from control panel 36 relating to a desired distance (e.g. an operator-input distance) between material feed sensor 37 and head 19 of paving material in front of screed 18. As another input 210, controller 202 may receive a feed sensor signal 214 from material feed sensor 37, indicative of the measured distance between sensor 37 and head 19 of paving material in front of screed 18. As another input 210, controller 202 may receive an auger speed signal 216 indicative of the rotational speed of auger 16. In some aspects, auger 16 may operate on an open loop control circuit such that controller 202 does not receive speed feedback from auger 16 (i.e., auger 16 and/or auger controller 106 do not include a speed sensor to return speed information to controller 202). In such aspects, controller 202 may use a current signal transmitted to auger controller 106 as the auger speed signal 216. The current signal transmitted to auger controller 106 indicates the speed at which auger 16 is to rotate, and thus the current signal serves as a virtual sensor from which controller 202 may derive auger speed. In other aspects, auger controller 106 may include a speed sensor, such as a resolver or encoder, that provides actual measurement of auger speed, and controller 202 may receive this measurement as auger speed signal 216.

Control system 200 may provide output 220 from controller 202 in the form of a conveyor speed command 222 that controls the rotational speed of the conveyor belt 42. Controller 202 may be configured to transmit the conveyor speed command 222 to conveyor controller 106 to drive conveyor belt 42 at a predetermined rotational speed. As mentioned, conveyor speed may be related to auger speed (i.e. conveyor speed may be expressed as a ratio relative to auger speed) in order to ensure consistent deposition of the paving material.

Controller 202 may include memory 240 and one or more processors 245. Memory 240, and/or a secondary storage device associated with controller 202, may store data and/or software instructions that may assist controller 202 in performing various functions, such as the functions of method 300 of FIG. 3. Further, memory 240 and/or secondary storage device associated with controller 202 may also store data received from the various inputs 210. Processor 245 may be configured to execute the software instructions. Numerous commercially available processors can be configured to perform the functions of processor 245. It should be appreciated that controller 202 could readily embody as a general machine controller capable of controlling numerous other machine functions. Alternatively, a special-purpose machine controller could be provided. Various other known circuits may be associated with controller 202, including signal-conditioning circuitry, communication circuitry, hydraulic or other actuation circuitry, and other appropriate circuitry.

INDUSTRIAL APPLICABILITY

During operation of paving machine 10, the ratio of conveyor speed relative to auger speed may remain relatively constant provided that machine 10 is traveling at a constant speed and depositing a consistent volume of paving material. However, variations or abnormalities in the ground surface onto which the paving material is deposited can alter the demand for paving material. For example, machine 10 may need to temporarily deposit more material when traversing a grade change or pothole in order to maintain a consistent mat thickness.

Further, controller 202 is programmed to automatically increase auger speed if more paving material is needed during a paving operation, such as if the travel speed of machine 10 increases, thickness of mat increases, etc. However, without a corresponding increase to conveyor speed, the increase in auger speed does not actually result in substantially more paving material being spread by auger 16, and thus paved by screed 18. That is, an increase in auger speed without a corresponding increase in conveyor speed does not significantly increase the rate at which auger 16 spreads paving material across screed 18, and thus the rate of head 19 of paving material is substantially unaffected. For example, if the machine travel speed or thickness of the mat increases, controller 202 will automatically increase auger speed in an effort to provide more paving material, but more paving material will not actually be supplied absent a corresponding increase in conveyor speed. This can result in auger 16 rotating at speeds greater than ideal for mat formation. The same principle applies if a reduction in paving material is required; auger speed may be reduced but, without a corresponding drop in conveyor speed, the rate of paving material spread by auger does not significantly change.

The present disclosure is related to the paving machine 10 including the control system 200. The control system 200 detects the head 19 of paving material in front of in screed 18 (e.g., the distance to material feed sensor 37, shape of head 19, and/or volume of head 19, as described herein) and automatically adjusts the conveyor speed based on auger speed to substantially maintain a predetermined distance between sensor 37 and head 19 of paving material, and to maintain auger speed within an ideal range. For example, if additional paving material is required by auger 16 and screed 18 in order to maintain a consistent mat thickness during steady state operation of machine 10, the conveyor speed is automatically increased to maintain a necessary volume of material in front of screed 18 to feed auger 16, and to prevent auger from rotating faster than an ideal speed.

Figure 3:
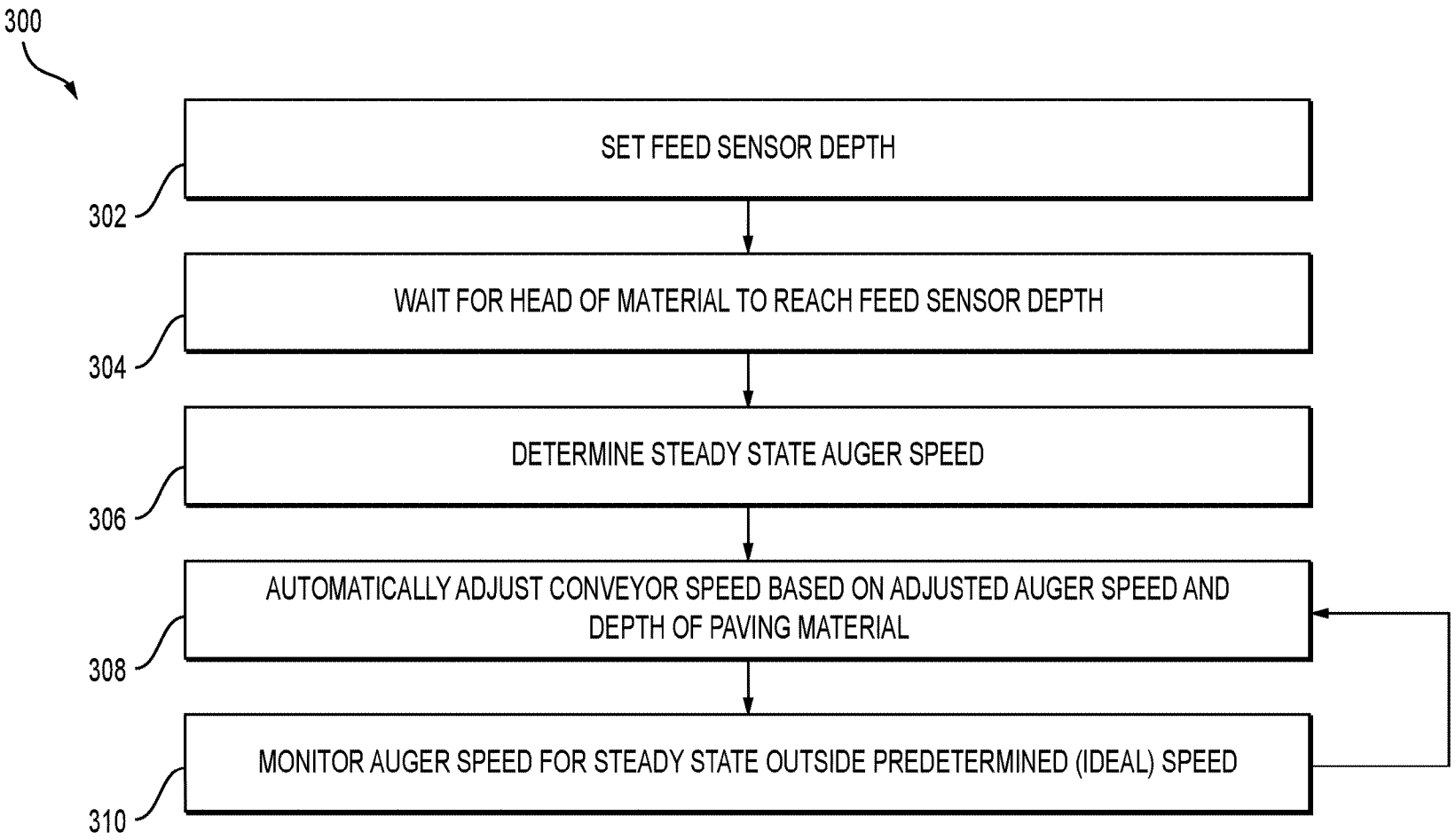
FIG. 3 is a flow diagram of a method for controlling the delivery of paving material from the paving machine of FIG. 1, according to an aspect of the present disclosure.

FIG. 3 is a flow diagram illustrating an exemplary method 300 that may be performed by control system 200 to control auger speed and conveyor speed in order to provide consistent delivery of paving material in front of screed 18 and, ultimately, to form a consistent mat substantially free of defects. Method 300 allows for the automated adjustment of the material feed system to achieve the optimum auger speed to prevent mat defects such as material segregation. This will also improve the wear life of the components associated with auger 16. Method 300 includes, at step 302, setting feed sensor depth. Feed sensor depth corresponds to the desired depth and/or volume of head 19 of paving material in front of screed 18 to ensure deposition of a consistent mat substantially free of imperfections. Further, feed sensor depth may be selected so that if an abnormality in the ground surface forces the auger 16 to deposit additional paving material to maintain a consistent mat thickness, there is a sufficient volume of paving material in front of screed 18 to ensure that auger 16 is not starved for paving material. In some aspects, feed sensor depth may be input by an operator into the control panel 36 during setup of machine 10 to perform a paving operation. Controller 202 may thus receive the manually input feed sensor depth from the control panel 36. In other aspects, feed sensor depth may be preprogrammed into controller 202.

Method 300 further includes, at step 304, waiting for head 19 of paving material in front of screed 18 to stabilize at the feed sensor depth. In particular, conveyor belt 42 is actuated to feed paving material to auger 16, which then spreads the paving material outward forming head 19 of paving material in front of screed 18. An initial speed of conveyor belt 42 may be set automatically by the control system 200, for example according to one or more preprogrammed parameters (e.g., a preprogrammed ratio of conveyor speed to auger speed). Alternatively, the initial speed of the conveyor belt 42 may be manually input by the operator(s) into the control panel 36. Once the depth/volume of head 19 of the paving material in front of screed 18 satisfies the feed sensor depth, as measured for example by material feed sensor 37, the paving operation can commence. In some aspects, the operator may adjust the feed sensor depth during initial operation of machine 10 if head 19 of paving material does not stabilize based on visual inspection. For example, if the operator observes that head 19 of paving material is inadequately distributed across width of screed 18 at the initial feed sensor depth, operator may adjust feed sensor depth to achieve a target depth/volume of head 19 of paving material.

Method 300 further includes, at step 306, determining a steady state rotational speed of auger 16. The steady state speed of auger 16 is the speed at which auger 16 rotates during a constant, steady state paving operation (i.e. no changes to screed width, mat thickness, or travel speed) of machine 10, which is reached after a transient initiation period during which machine 10 is brought up to operating parameters. As described herein with reference to FIG. 2, determination of the steady state auger speed may be performed using a virtual sensor by deriving the auger speed from the current signal sent to auger controller 106. In some aspects, step 306 may be initiated automatically by controller 202 in response to a determination by controller 202 that steady state operation of machine 10 has been reached. Controller 202 may make a determination that steady state operation of machine 10 has been reached based on, for example, machine 10 reaching a predetermined traverse speed and no changes to screed width, mat thickness, and/or traverse speed for a predetermined amount of time. In other aspects, step 306 may be initiated by an operator(s) inputting a command to controller 202 (e.g., via control panel(s) 36) to indicate that steady state operation has been reached.

Method 300 further includes, at step 308, automatically adjusting the speed of conveyor belt 42 based on auger speed and head 19 of paving material as measured by material feed sensor 37. The conveyor speed may be adjusted if the auger speed determined at step 306 deviates from a predetermined ideal speed. In some aspects, the predetermined ideal speed may is based on empirical data for paving a mat of consistent thickness that is substantially free of imperfections (e.g., material segregation). In some aspects, the predetermined ideal speed may be a range may be about 20 rpm to about 40 rpm. If head 19 of paving material, as measured by material feed sensor 37, is at a target level consistent with the feed sensor depth set at step 302, but auger speed exceeds an upper limit of the ideal range, controller 202 determines that conveyor belt 42 is not delivering sufficient paving material to auger 16. Controller 202 automatically increases conveyor speed to deliver more paving material toward auger 16. With more paving material being supplied by conveyor belt 42, auger 16 does not need to rotate as fast to move the necessary volume of material to maintain the target depth/volume of head 19 of paving material. That is, because conveyor belt 42 is supplying more paving material, each rotation of auger 16 can spread a greater volume of material, so auger 16 need not rotate as fast to maintain the target depth/volume of head 19 of paving material. Controller 202 may thus automatically decrease the auger speed toward the ideal range without adversely affecting the depth/volume of head 19 of paving material. Conveyor speed may be decreased until the resultant drop in auger speed brings auger speed within the ideal range.

Similarly, if head 19 of paving material, as measured by material feed sensor 37, is at a target level consistent with the feed sensor depth set at step 302, but auger speed is less than a lower limit of the ideal range, controller 202 determines that conveyor belt 42 is delivering too much paving material to auger 16. Controller 202 automatically decreases conveyor speed to deliver less paving material toward auger 16. With less paving material being supplied by conveyor belt 42, auger 16 may rotate faster without spreading too much paving material across screed 18. Controller 202 may thus automatically increase the auger speed toward the ideal range without adversely affecting the depth/volume of head 19 of paving material. Conveyor speed may be decreased until the resultant rise in auger speed brings auger speed within the ideal range.

Adjusting the speed of the conveyor belt 42 at step 308 may further be based on a change to head 19 of material in front of the screed 18, as measured by material depth sensor 37. For example, conveyor speed may be increased if head 19 of paving material is decreasing, as detected by material feed sensor 37, faster than the paving material is being replenished by conveyor belt 42. This could occur, for example, if machine 10 is traversing a grade change or pothole which results in additional paving material being deposited by auger 16. To account for such scenarios while avoiding unnecessary changes to conveyor speed, step 308 may include, prior to making an adjustment to the conveyor speed, determining that the need for additional paving material is not temporary. In particular, the conveyor speed may be adjusted only if the demand for additional paving material (as determined by material depth sensor 37) persists for a predetermined amount of time. Conversely, if the demand for additional paving material is only temporary (i.e., does not persist for the predetermined time), the conveyor speed is maintained without adjustment, and the material delivery is allowed to naturally return to steady state after the temporary need for additional material is no longer present. This eliminates unnecessary changes to conveyor and auger speeds that can result in erratic auger behavior, excessive increase in head 19 of paving material, and inconsistent mat formation.

Method 300 further includes, at step 310, monitoring the speed of auger 16 for steady state outside of the ideal range of speeds. If the control system 200 determines that the actual speed of the auger 16 (i.e. the speed indicated by auger speed signal 216) deviates from the ideal range of speeds, the control system 200 returns to step 308 and adjusts the conveyor speed to automatically adjust the auger speed back toward the ideal range of speed, as described herein. In some aspects, controller 202 may be configured to transmit a message to control panel(s) 36 if the predetermined auger speed is unable to be maintained during the paving operation. Steps 308 and 310 may be performed intermittently (i.e. at predetermined time intervals) or continuously during steady state operation of machine 10, thereby providing for consistent paving material delivery and deposition without the need for operator intervention.

The control system 200 of the present disclosure may, as described above, automatically supply an appropriate amount of material to screed 18 to ensure that auger 16 has sufficient material to deposit the mat at a consistent thickness. As such, the operator(s) need not constantly monitor and manually adjust the conveyor speed (or the ratio of conveyor speed to auger speed) to maintain ideal auger speed and the head 19 of paving material in front of the screed 18 needed to pave the mat at a consistent thickness. Furthermore, as a result of the principles explained above, mat consistency is less adversely affected by abnormalities and/or inconsistencies in the ground surface onto which the mat is deposited (e.g., grade changes and/or potholes).

While the principles of the present disclosure are embodied in paving machine 10 in the foregoing description and accompanying drawings, the principles of the present disclosure can be utilized in a multitude of applications in the material conveyance industry. In particular, adjusting the speed of a second conveying system (e.g., conveyor belt 42) to maintain ideal operational speed of a first conveying system (e.g., auger 16) can be utilized in substantially any conveyance system in which material is sensitive to segregation, and/or in any multi-conveyor system in which first conveying device has a variable, non-constant output. In particular, a target operations speed or level of first conveyor system is maintained by adjusting the speed or level of second (or multiple other) conveying device, as described herein.

It will be apparent to those skilled in the art that various modifications and variations can be made to the disclosed machine without departing from the scope of the disclosure. Other aspects of the machine will be apparent to those skilled in the art from consideration of the specification and practice of the control system for a paving machine disclosed herein. It is intended that the specification and examples be considered as exemplary only, with a true scope of the disclosure being indicated by the following claims and their equivalents.

What is claimed is:

1. A paving system, comprising:
- a paving machine, including:
  - a drive assembly;
  - a paving material delivery system, including a hopper, a conveyor assembly, an auger, and a screed;
  - a material depth sensor configured to detect a head of paving material downstream of the auger and in front of the screed; and
  - a controller in communication with the material depth sensor, the controller configured to:
    - receive a feed sensor signal from the material depth sensor;
    - receive an auger speed signal indicative of a speed of the auger; and
    - adjust a conveyor speed based on at least one of the feed sensor signal and the auger speed signal.

2. The paving system of claim 1, wherein the controller is configured to automatically adjust conveyor speed in response to the paving machine reaching a steady state operation.

3. The paving system of claim 1, wherein the controller is configured to adjust the speed of the auger to a predetermined speed for a steady state operation of the paving machine in response to adjusting the conveyor speed.

4. The paving system of claim 3, wherein the predetermined speed is in a range of about 20 rpm to about 40 rpm.

5. The paving system of claim 3, wherein the controller is further configured to adjust the conveyor speed by decreasing the conveyor speed in response to the speed of the auger being above the predetermined speed.

6. The paving system of claim 3, wherein the controller is further configured to adjust the conveyor speed by increasing the conveyor speed in response to the speed of the auger being below the predetermined speed.

7. The paving system of claim 3, wherein the controller is further configured to adjust the conveyor speed by increasing the conveyor speed in response to the feed sensor signal indicating a decrease in the head of paving material.

8. The paving system of claim 1, wherein the material depth sensor is an ultrasonic sensor.

9. The paving system of claim 1, wherein the controller is configured to determine, prior to adjusting the conveyor speed, that an increased demand for additional paving material is not temporary.

10. The paving system of claim 1, wherein the controller is configured to monitor the speed of the auger for an auger speed outside of a predetermined speed range.

11. A method for controlling delivery of paving material from a paving machine, the method comprising:
- setting a feed sensor depth;
- waiting for a head of paving material to stabilize at the feed sensor depth;
- determining a steady state rotation speed of an auger of the paving machine;
- detecting a change to the head of paving material downstream of the auger and upstream of a screed of the paving machine;
- automatically adjusting a speed of a conveyor of the paving machine based on the auger speed or the change to the head of paving material; and
- monitoring the speed of the auger at a steady state for an auger speed outside of a predetermined speed range.

12. The method of claim 11, further comprising:
- adjusting the auger speed to the predetermined speed in response to determining that the speed of the auger is outside of the predetermined speed range.

13. The method of claim 11, wherein determining the steady state rotation speed of the auger comprises deriving the steady state rotation speed of the auger from a current signal sent to an auger controller.

14. The method of claim 11, further comprising:
- transmitting a message to one or more control panels if the predetermined speed in unable to be maintained.

15. The method of claim 11, wherein setting the feed sensor depth comprises receiving feed sensor depth input from an operator of the paving machine.

16. The method of claim 11, wherein monitoring the speed of the auger is performed intermittently during operation of the paving machine.

17. The method of claim 11, wherein monitoring the speed of the auger is performed continuously during operation of the paving machine.

18. The method of claim 11, wherein the predetermined speed range is a range of about 20 rpm to about 40 rpm.

19. The method of claim 11, wherein automatically adjusting the speed of the conveyor comprises increasing the conveyor speed in response to the speed of the auger being above the predetermined speed range.

20. The method of claim 19, wherein automatically adjusting the speed of the conveyor comprises decreasing the conveyor speed in response to the speed of the auger being below the predetermined speed range.

* * * * *